US006930587B1

(12) United States Patent
Procházka

(10) Patent No.: US 6,930,587 B1
(45) Date of Patent: Aug. 16, 2005

(54) ARRANGEMENT OF ENTRANCE UNIT FOR PROTECTED AREAS

(76) Inventor: Zdeněk Procházka, Hybešova 728, 691 23 Pohořelice (CZ)

( * ) Notice: Subject to any disclaimer, the term of this patent is extended or adjusted under 35 U.S.C. 154(b) by 0 days.

(21) Appl. No.: 10/030,376

(22) PCT Filed: May 9, 2000

(86) PCT No.: PCT/CZ00/00031

§ 371 (c)(1),
(2), (4) Date: Nov. 9, 2001

(87) PCT Pub. No.: WO00/68897

PCT Pub. Date: Nov. 16, 2000

(30) Foreign Application Priority Data

May 10, 1999 (CZ) ..... 1655-99

(51) Int. Cl.[7] ..... G07C 9/00
(52) U.S. Cl. ..... 340/5.21; 340/5.42; 340/5.72; 340/425.5
(58) Field of Search ..... 340/5.21, 5.31, 340/5.42, 5.72, 425.5; 705/1, 13; 455/456.6; 701/213

(56) References Cited

U.S. PATENT DOCUMENTS 3,842,629 A 10/1974 Pazer et al.
4,965,821 A 10/1990 Bishop et al.
5,289,369 A * 2/1994 Hirshberg ..... 705/13
5,614,703 A 3/1997 Martin et al.
5,726,885 A * 3/1998 Klein et al. ..... 455/456.6
6,240,365 B1 * 5/2001 Bunn ..... 701/213

FOREIGN PATENT DOCUMENTS

| | | |
|---|---|---|
| CA | 2227664 | 1/1998 |
| FR | XP 687911 | 10/1996 |
| NL | 1006445 | 1/1997 |

* cited by examiner

*Primary Examiner*—Edwin C. Holloway, III
(74) *Attorney, Agent, or Firm*—Hovey Williams LLP

(57) ABSTRACT

In a protected area (1), equipped by an electronic lock (2) and by a reading device (3) of chip cards (4), connected to a discriminating unit (5), a user terminal (7) is located, which connected to an evaluation center (6). The evaluation center (6) is connected with an access events memory (9), with a discriminating unit (5) and with a monitoring terminal (8), while the access events memory (9) is also connected to the discriminating unit (5). This arrangement enables entrance into the protected area (1) only to authorized users, equipped by the pertinent chip card (4). This arrangement further enables the user, who ascertains damages, to transmit the report about discovered status via user terminal (7) into the evaluation center (6), which compares time of change of the status in the protected area (1) with time of access events, stored in the access events memory (9), assigns responsibility for ascertained damages and eventually abolishes the right of access for the responsible persons by means of discriminating unit (5) and that all can occur without personal presence or performance of supervising staff.

7 Claims, 1 Drawing Sheet

ARRANGEMENT OF ENTRANCE UNIT FOR PROTECTED AREAS

BACKGROUND OF THE INVENTION

1. Field of the Invention

The invention relates to an arrangement of entrance unit for protected areas where entrance is enabled for authorized users only.

2. Description of the Prior Art

Up to this time the entrance to protected areas with limited access users was provided by opening of a door or barriers according to the content of a magnetic card. The content of magnetic card could be the same for all users, in that case the technical solution would be simple and would be composed of a magnetic card reading device, comparing circuit, comparing the code saved on the card with the only correct code and the lock, releasing the door into area protected against other persons' entrance. This way it would not be possible to watch utilisation of protected area by separate users.

In more advanced versions the distinguishing code, saved on a magnetic or chip card or on some other carrier, was different for separate users, then the simple comparing circuit was replaced by the circuit comparing the distinguishing code of the inserted card with all admissible codes, representing separate users.

Connection was enhanced by access events memory, connected to the comparing circuit, and by the monitoring terminal, connected to access events memory. With this connection it was possible to survey the utilisation of protected area by separate users.

For areas utilised by a number of people with automatic open-up access however, the question of drawing consequences of damage responsibility which has arisen in these areas comes out regularly.

Especially with larger numbers of persons, larger numbers of shared areas, larger distances among them and a higher possibility of various damage it is not economical to solve these problems by the presence of supervision authorities on the spot, or by personal participation in checking on protected areas state and by investigation of acknowledged damages.

Absence of supervision, at the same time automation of all-access areas, without attendance unbinds self-discipline of people and leads regularly to a higher rate of damaging of equipment, especially with broad systems with apparently anonymous entrance. For example lift cages, railroad carridges, trams, telephone kiosk, public toilets and other areas, open to the public. These economical losses can be limited by arrangement which is presented by this invention.

SUMMARY OF THE INVENTION

The problem described above is solved by arrangement according to this invention, when the area, protected from access of unauthorised persons is accessible only over the barrier, released by an electronic lock, whose input is connected to the first output of discriminating unit and to its first input of discriminating unit is connected output of a distinguishing elements reading device e.g. chip card reading devices, which can serve as a distinguishing element and enable reading of the device to distinguish individual users asking for access into the protected area. Second output of discriminating unit is connected to the first input of access events memory, which stores sequence of access events inclusive of distinguishing code of individual users. Discriminating unit determines if the user, showing proof of his or her identity by certain distinguishing code, is authorised to access the protected area.

Principle of the invention is based on the fact that the arrangement is extended by at least one user terminal and at least one evaluation centre in such a way, that the first output of the user terminal is connected to the first input of evaluation centre and the first input of the user terminal is connected to the first output of evaluation centre. The second output of the evaluation centre is connected to the third input of discriminating unit, the third output of the evaluation centre is connected to the second input of discriminating unit, fourth output of the evaluation centre is connected to second input of the access events memory, while the second input of the evaluation centre is connected to the first output of the access events memory.

Between the second output of the evaluation centre and the third input of discriminating unit a monitoring terminal can be connected.

The user terminal is accessible to users of protected area for example by its location in the protected area and enables the user to pass over a message about protected area state found, especially about found damages, and time when they were recognised and about the identity of the user to the evaluation centre.

The evaluation centre compares automatically the moments of state changes of the protected area with the moments of access events, stored in the access events memory and assigns distinguishing code of the user who is responsible for the state change of the protected area on the basis of reports, received from the user terminal. Users' distinguishing codes and probability of responsibility for state changes of protected area, is passed over by the evaluation centre to the monitoring terminal, where they can be displayed on the screen, or printed or saved into the memory and can serve for the supervision authority of operator as proposals to cancel the authorisation for entrance into the protected area for individual indicated users. For this reason, the output from the monitoring terminal can be driven to the input of the discriminating unit, providing a change of discriminating unit output value when asking for authorisation of the entrance of the user with inserted distinguishing code from the state "ADMITTANCE AUTHORISED" to "ADMITTANCE UNAUTHORISED".

The input of the discriminating unit can be connected with the output of the evaluation centre via the monitoring terminal or directly. The direct connection is useful for automatic operation.

The user terminal, which enables passing over reports of the state of the protected area, of the moment of reported state found and entering user identity, is equipped by the reading device of distinguishing elements to its advantage.

The user terminal is to its advantage equipped with an display of summary of the complex protected area known state in the same moment, displaying for example in priority some items of the protected area state, which are more frequently used and that is why its input is connected with the evaluation centre output.

The user terminal is to its advantage joint with an control station on other auxiliary equipment, located inside the protected area, for example air-conditioning, radio, copier machine etc, which are interconnected to it for passing commands over.

The evaluation centre, which in the base of reports received from the user terminal compares automatically moments of state changes of protected area with moments of access events stored in the access events memory, and determines the distinguishing code of user who is suspected for causing the change of the state of the protected area and assigns the probability of responsibility to it. With advantage the responsibility is spread over several users during evaluation of one event. Past events connected to one user may influents the probability of responsibility during evaluation of following events. Because of passing over the inquiries and requests concerning details of access events the output of the evaluating centre is connected to the access events memory input and answers are passed over from access events memory output to the input of the evaluation centre.

The discriminating unit can be connected with more reading devices and more locks, which can be fixed to door of one but also to more different protected areas.

Access events memory can be connected with more discriminating units.

The evaluation centre can be connected with more discriminating units and more memories of accesses, the monitoring terminal can be connected with more discriminating units and more evaluation centres.

The evaluation centre can be to its advantage common for more protected areas, or more user terminals.

Protected area is to its advantage the inner area of a car, lift, building, room of telephone kiosk, cash dispenser, laundry, room of Official Secrets Acts, etc.

Connection between outputs and inputs of separate units of the circuit is to its advantage provided by something other than a solid connection, i.e. by a wireless link.

The main advantage of this arrangement is in quicker and easier messages transfer referring about protected area damage and its equipment, responsibility assessment for damage and/or occasional abolishment of access rights to users responsible for protected area damage, this can all occur without personal presence or performance of supervising staff.

BRIEF DESCRIPTION OF THE DRAWINGS

The invention is, in the following, described further on an example of an embodiment by means of a drawing on which the scheme shows the arrangement of entrance unit to protected area.

DETAILED DESCRIPTION OF THE PREFERRED EMBODIMENT

Figure 1:
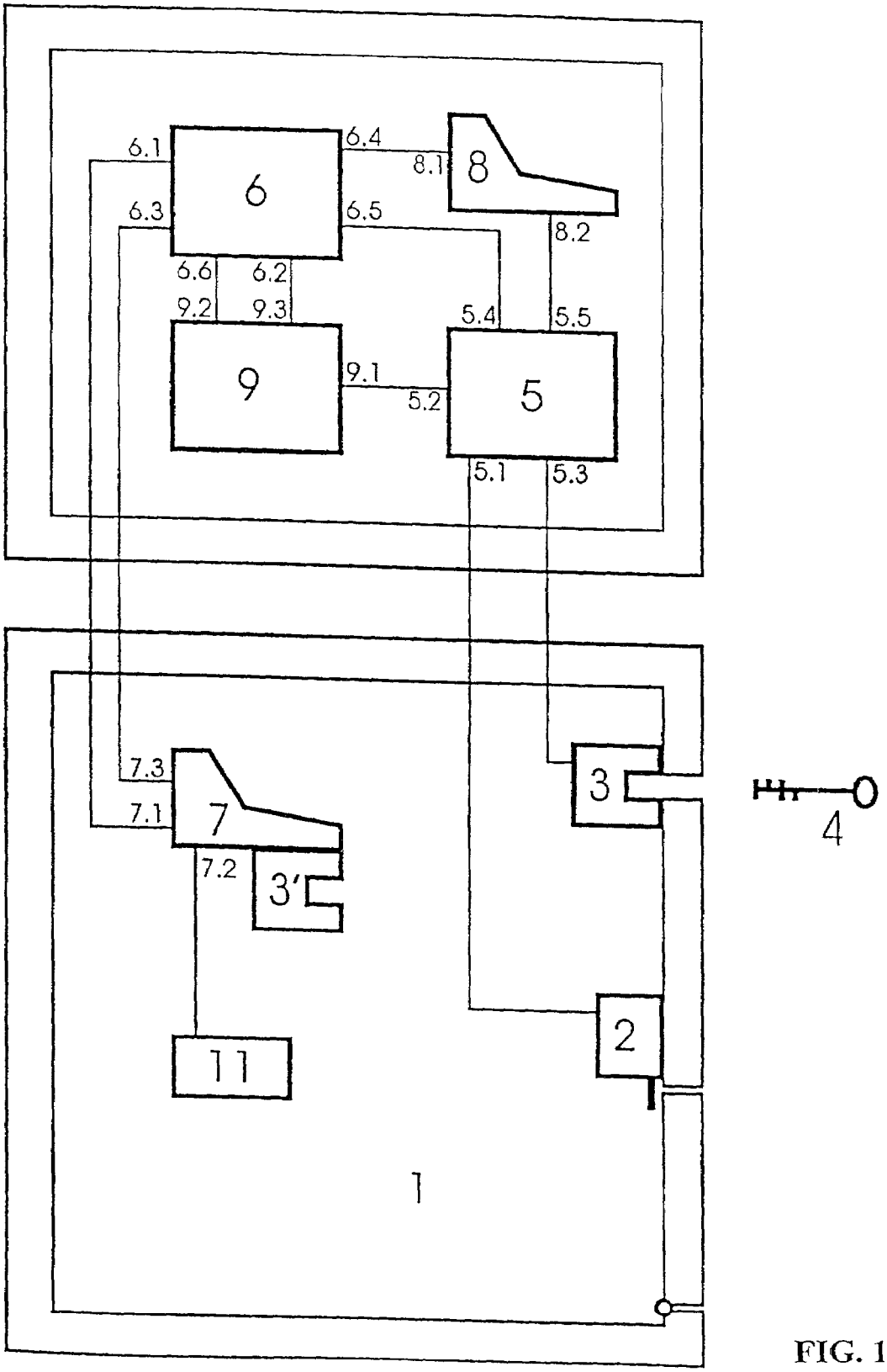

Drawing shows a protected area 1 with door, released by electronic lock 2, whose entrance is connected to the first output 5.1 of discriminating unit 5. To the first input 5.3 of discriminating unit 5 is connected output of reading device 3 of chip cards 4. Second output 5.2 of discriminating unit 5 is connected with the first input 9.1 of access events memory 9.

In the protected area 1 an user terminal 7 is located, the first output 7.1 of which is connected to the first input 6.1 of evaluation centre 6, while its first input 7.3 is connected to the first output 6.3 of evaluation centre 6. Second output 6.4 of evaluation centre 6 is connected to input 8.1 of the monitoring terminal 8, the third output 6.5 is connected to second input 5.4 of discriminating unit 5, the fourth output 6.6 is connected to second input of 9.2 of access events memory 9, while the second input 6.2 of evaluation centre 6 is connected to the first output 9.3 of access events memory 9. Output 8.2 of monitoring terminal 8 is connected to the third input 5.5 of discriminating unit 5. Second output 7.2 of user terminal is connected to the input of auxiliary device 11.

Following example of an embodiment of the invention does not limit the scope of the protection.

Shared automobiles of transport club are fitted by electronic door lock 2. Inner area of each vehicle is the protected area 1, which can not be entered off the door, operated by electronic lock 2. Reading device 3, located on the vehicle, distinguishes individual users according to chip cards 4, which are delivered to the members by Transport club Centre. With inserting the card 4 into reading device 3 this notifies distinguishing code of inserted card via radio link to discriminating unit 5, located in the club centre.

Discriminating unit 5 identifies, if asking user is authorised to use the vehicle and if so, it unlocks door lock 2 via the radio link and simultaneously passes over access event into access events memory 9, located also in the club centre.

In every car there is an user terminal 7 located in the form of display with touch-screen, which displays car state, compiled according to previous users messages and enables the new user to set-up investigated real state.

If the new user discovers, that in the car faults existing contrary to the displayed known state (amount of dirt, damaged upholstery, non functional air conditioning etc), he will set-up new investigated facts by means of user terminal via radio connection to the evaluation centre 6, located in the centre of the club connected to access events memory 9.

The evaluation centre 6 looks up previous access event in access events memory 9 and will cancel the authorisation for using club vehicle to user who used the vehicle in previous case by the storing to proper input 5.4 of discriminating unit 5, to which is its output 6.5 connected. Simultaneously this decision is passed over to the input 8.1 of monitoring terminal 8, to which is the output 6.4 of evaluation centre connected. The monitoring terminal 8, located in the centre of the club can be for example a personal computer with a printer.

The user terminal 7 serves simultaneously as a control station of auxiliary equipment 11 of the car (air conditioning, engine, radio etc.). It is equipped by reading device 3' of chip cards 4, which serves as confirmation of the presence of a certain user with setting up the state of protected area 1. Discriminating unit 5, evaluation centre 6, access events memory 9, monitoring terminal 8, which are located in the centre of the club, are common for all club cars.

What is claimed is:

1. An arrangement of an entrance unit for a protected area, comprising:

a discriminating unit having a first and second unit input and a first and second unit output;

an electronic lock having an electronic lock input, said lock input being operatively connected to said first unit output;

a reading device for reading a carrier with an electronically-readable portion, said reading device having a reading device output operatively connected to said first unit output of the discriminating unit;

an access events memory having a first and second memory input and a first memory output, said first memory input being operatively connected to the second unit output of the discriminating unit;

an evaluation centre having a first and second centre input and a first, third and fourth center output, said second unit input being operatively connected to said third centre output; and a user terminal for enabling a user to communicate any decrease in quality of the protected area to the evaluation centre, said user terminal having a first user terminal input and a first user terminal output, said first centre input being connected to said first user terminal output, said first centre output being connected to said first user terminal input, said second centre input being connected to said first access events memory output, and said fourth centre output being connected to said second access events memory input, wherein the evaluation centre may, responsive to a decrease in quality of the protected area, cancel the authorization for using the protected area to the carrier with an electronically-readable portion of the user who used the protected area on a previous occasion.

2. The arrangement according to claim 1, further comprising a second centre output, a third unit input, and a monitoring terminal operatively connected to the second centre output and to the third unit input and operatively positioned therebetween.

3. The arrangement according to claim 1, said user terminal further comprising a reading unit for reading of carriers with electronically-readable portions.

4. The arrangement according to claim 1, said user terminal further comprising a second terminal output operatively connected to an auxiliary equipment input.

5. The arrangement according to claim 2, said discriminating unit being operatively connected to at least one reading device and at least one lock, said access events memory being operatively connected to at least one discriminating unit, said evaluation centre being operatively connected to at least one discriminating unit and at least one access event memory, said monitoring terminal being operatively connected to at least one discriminating unit and to at least one evaluation centre.

6. The arrangement according to claim 1, wherein connection of said lock input, said reading device output, said first user terminal input, and said first user terminal output with said first and second unit input and said evaluation centre is provided via wireless link.

7. The arrangement according to claim 1, wherein said carrier with an electronically-readable portion is a smart card, chip card or magnetic card.

* * * * *